US007651202B2

(12) United States Patent
Kachi et al.

(10) Patent No.: US 7,651,202 B2
(45) Date of Patent: Jan. 26, 2010

(54) LIQUID EJECTION HEAD AND IMAGE FORMING APPARATUS

(75) Inventors: Yasuhiko Kachi, Kanagawa (JP); Seiichiro Oku, Kanagawa (JP); Toshiya Kojima, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 575 days.

(21) Appl. No.: 11/489,512

(22) Filed: Jul. 20, 2006

(65) Prior Publication Data

US 2007/0024676 A1 Feb. 1, 2007

(30) Foreign Application Priority Data

Jul. 27, 2005 (JP) ..... 2005-217535

(51) Int. Cl.
*B41J 2/045* (2006.01)

(52) U.S. Cl. ..... 347/68

(58) Field of Classification Search ..... 347/68, 347/69–72

See application file for complete search history.

(56) References Cited

U.S. PATENT DOCUMENTS

2002/0130930 A1* 9/2002 Moriya et al. ..... 347/70

FOREIGN PATENT DOCUMENTS

JP 9-314833 A 12/1997
JP 2001-179973 A 7/2001
JP 2003-127366 A 5/2003
JP 2004-1550 A 1/2004

* cited by examiner

*Primary Examiner*—K. Feggins
(74) *Attorney, Agent, or Firm*—Birch, Stewart, Kolasch & Birch, LLP

(57) ABSTRACT

The liquid ejection head comprises: a plurality of pressure chambers connected to a plurality of nozzles from which liquid is ejected, the pressure chambers being arranged in a two-dimensional configuration; a diaphragm which constitutes a wall of each of the pressure chambers, the wall being located opposite to the nozzles; a plurality of piezoelectric elements disposed at positions corresponding to the pressure chambers on a surface of the diaphragm which is on an opposite side of the diaphragm from the pressure chambers, the piezoelectric elements causing portions of the diaphragm corresponding to the pressure chambers to deform; an intermediate plate which is located on a piezoelectric element side of the diaphragm where the piezoelectric elements are disposed and which forms a space around a periphery of each of the piezoelectric elements; electrical wires for electrically connecting drive circuits which drives the piezoelectric elements with drive electrodes of the piezoelectric elements, the electrical wires being disposed in the intermediate plate; and an ink pool section which is located across the intermediate plate from the diaphragm and which supplies the liquid to the pressure chambers.

11 Claims, 14 Drawing Sheets

LIQUID EJECTION HEAD AND IMAGE FORMING APPARATUS

BACKGROUND OF THE INVENTION

1. Field of the Invention

The present invention relates to a liquid ejection head and an image forming apparatus, and more particularly, to a liquid ejection head and an image forming apparatus in which a plurality of pressure chambers connected to a plurality of nozzles from which liquid is ejected are arranged in a two-dimensional configuration.

2. Description of the Related Art

In print heads (also called simply "heads") mounted in image forming apparatuses, a so-called piezoelectric inkjet head is known, and for example, Japanese Patent Application Publication No. 9-314833, Japanese Patent Application Publication No. 2003-127366, Japanese Patent Application Publication No. 2001-179973, and Japanese Patent Application Publication No. 2004-1550 disclose such piezoelectric inkjet heads. In such a piezoelectric inkjet head, ink accommodated inside pressure chambers is pressurized by using the displacement of piezoelectric elements, ink droplets are ejected from nozzles connected to the pressure chambers, and thereby an image is formed on a recording medium.

Japanese Patent Application Publication No. 9-314833 discloses a head in which piezoelectric elements are arranged on a diaphragm which forms one wall of each pressure chamber. In this head, a reservoir is provided on the piezoelectric element side of the diaphragm, and ink is supplied from the reservoir to the pressure chambers via supply ports formed so as to pass through the piezoelectric elements and the diaphragm.

Japanese Patent Application Publication No. 2003-127366 discloses a head in which a space is provided in order to prevent the movement of piezoelectric elements formed on a diaphragm and a sealing substrate is provided for sealing the space. The reservoir is formed so as to pass through the diaphragm in a part outside the region of the row of pressure chambers, in such a manner that ink is supplied from the lower side of the pressure chambers.

Japanese Patent Application Publication No. 2001-179973 discloses a head having a structure in which the partitions of an ink supply tank provided on the piezoelectric element side of a diaphragm seal off the piezoelectric elements. In this head, ink is supplied to the pressure chambers from an ink supply tank, via ink supply channels formed in the diaphragm in regions other than the regions corresponding to the pressure chambers.

Japanese Patent Application Publication No. 2004-1550 discloses a head composed by stacking up a pressure chamber substrate in which pressure chambers are formed, a common electrode film having piezoelectric elements formed respectively at positions corresponding to pressure chambers, and a reservoir member having a lid-shaped structure which encloses a plurality of piezoelectric elements therein.

In recent years, there have been increasing demands for improved image quality and higher printing speeds, in inkjet heads. In order to meet these demands, it is necessary to form heads to higher density, and to enable them to eject high-viscosity ink at a high frequency.

However, in a head formed to high density, the ink flow channels tend to become highly complicated. As a result, the flow path resistance to the ink inside the head can increase, refilling characteristics can be degraded, it is difficult to eject high-viscosity ink at a high frequency, and consequently ink ejection becomes instable.

Furthermore, as the density of the head increases, the space for the electrical wires (internal wires) for driving the piezoelectric elements becomes insufficient, and the difficulty of wiring increases.

In the head disclosed in Japanese Patent Application Publication No. 9-314833, thin-film transistor elements (TFT) of equal number to the piezoelectric elements are arranged on a side face of the head, and wires from the TFTs are extended to, and connected to, drive electrodes of the piezoelectric elements. However, no consideration is given to a composition in which the piezoelectric elements are arranged in a two-dimensional configuration and the composition is not suitable for installation of high-density wiring.

In the head disclosed in Japanese Patent Application Publication No. 2003-127366, electrode wires which are connected electrically to a common electrode which is common for a plurality of piezoelectric elements are provided on a sealing substrate, and connecting sections for connecting these electrode wires with drive circuits for driving the piezoelectric elements are provided on the sealing substrate. However, the description only relates to a composition with one row of piezoelectric elements, and therefore, similarly to Japanese Patent Application Publication No. 9-314833, it is not suitable for installation of high-density wiring. Moreover, if the head disclosed in Japanese Patent Application Publication No. 2003-127366 is formed to a high density, then the ink flow channels become complicated, and there is a possibility that the refilling characteristics decline.

In the head disclosed in Japanese Patent Application Publication No. 2001-179973, electrical wires (internal wires) extended from the electrodes of the piezoelectric elements to the end section of the head are disposed in the same plane as the diaphragm on which the piezoelectric elements are disposed, and hence there is a high possibility that problems occur in the electrical wires, and the composition is therefore unsuitable for achieving high density in the head. Furthermore, the ink flow channels are composed by a plurality of bending channels, thus causing the refilling characteristics to decline, and making it difficult to eject high-viscosity ink at a high frequency.

In Japanese Patent Application Publication No. 2004-1550, there is no discussion of the method of installing the electrical wires (internal wires) for driving the piezoelectric elements, and there is a possibility that the above-described problems occur in these electrical wires.

SUMMARY OF THE INVENTION

The present invention is contrived in view of the foregoing circumstances, an object thereof being to provide a liquid ejection head and an image forming apparatus in which installation of high-density wiring can be achieved, and refilling characteristics can be improved.

In order to attain the aforementioned object, the present invention is directed to a liquid ejection head comprising: a plurality of pressure chambers connected to a plurality of nozzles from which liquid is ejected, the pressure chambers being arranged in a two-dimensional configuration; a diaphragm which constitutes a wall of each of the pressure chambers, the wall being located opposite to the nozzles; a plurality of piezoelectric elements disposed at positions corresponding to the pressure chambers on a surface of the diaphragm which is on an opposite side of the diaphragm from the pressure chambers, the piezoelectric elements causing portions of the diaphragm corresponding to the pressure chambers to deform; an intermediate plate which is located on a piezoelectric element side of the diaphragm where the piezoelectric elements are disposed and which forms a space around a periphery of each of the piezoelectric elements; electrical wires for electrically connecting drive circuits which drives the piezoelectric elements with drive electrodes of the piezoelectric elements, the electrical wires being disposed in the intermediate plate; and an ink pool section which is located across the intermediate plate from the diaphragm and which supplies the liquid to the pressure chambers.

According to this aspect of the present invention, the electrical wires (internal wires) for driving the piezoelectric elements are disposed in the intermediate plate which is different from the diaphragm on which the piezoelectric elements are disposed. Therefore, it is possible to provide the electrical wires so as to overlap with the piezoelectric elements, and hence installation of high-density wires becomes possible.

Moreover, the ink pool section (e.g., the common liquid chamber or the common flow channel) is disposed across the plurality of pressure chambers from the nozzles (via the diaphragm and the intermediate plate). Hence, the composition of the liquid supply channels which connect the ink pool section with the pressure chambers is simplified, and it is possible to reduce the flow channel resistance with respect to the liquid. Accordingly, the refilling performance is improved, and it is possible to eject the liquid of high viscosity at a high frequency.

Preferably, the electrical wires are disposed in the intermediate plate in such a manner that at least a portion of the electrical wires overlaps with the piezoelectric elements.

Preferably, the intermediate plate includes at least a plate member where the electrical wires are disposed.

According to this aspect of the present invention, the structure of the intermediate plate can be simplified and hence the liquid ejection head can be manufactured more readily.

Preferably, the electrical wires are disposed on a diaphragm side of the plate member.

According to this aspect of the present invention, electrical insulation processing is not required on the common liquid chamber side (ink pool section side) of the plate member. The "diaphragm side" means a near side to the diaphragm.

Preferably, the electrical wires are disposed on both surfaces of the plate member.

According to this aspect of the present invention, installation of higher-density wiring becomes possible, in comparison with a case where electrical wires are disposed on only one surface of the plate member.

Preferably, the drive circuits are disposed on both surfaces of the plate member.

According to this aspect of the present invention, installation of high-density wiring becomes possible, and hence the liquid ejection head can be reduced in size.

Preferably, the plate member is made of a bendable sheet material; and the plate member is bent toward an ink pool section side in a region other than regions where the piezoelectric elements are disposed.

According to this aspect of the present invention, the clearance between the liquid ejection head and the recording medium can be increased, and the liquid ejection head can be reduced in size. The "ink pool section side" means a near side to the ink pool section.

Preferably, the plate member includes a plurality of layers on which the electrical wires are disposed.

According to this aspect of the present invention, the electrical wires can be distributed to a plurality of layers, and hence the wiring can be performed readily and installation of high-density wiring becomes possible.

Preferably, a portion of the electrical wires is disposed on an internal surface of a hole section of the intermediate plate which constitutes a portion of a liquid supply channel which connects the ink pool section with each of the pressure chambers.

According to this aspect of the present invention, it is not necessary to form another hole section for the electrical wires passing through the intermediate plate.

Preferably, the intermediate plate include a hole section; the diaphragm include a hole section which constitutes a portion of a liquid flow channel; cross-sectional area of the hole section included in the intermediate is greater than cross-sectional area of the hole section included in the diaphragm; and the hole section included in the intermediate plate is an elongated hole which is elongated in a wiring direction in which the electrical wires in the intermediate plate are extended.

According to this aspect of the present invention, refilling performance is improved, and it becomes possible to install wires at higher density.

Preferably, a partition constituting the ink pool section includes at least a heat radiation member; and the drive circuits are disposed on the partition.

According to this aspect of the present invention, it is possible to radiate heat from the drive circuits.

In order to attain the aforementioned object, the present invention is also directed to an image forming apparatus comprising one of the above liquid ejection head.

According to present invention, the electrical wires (internal wires) for driving the piezoelectric elements are disposed in the intermediate plate which is different from the diaphragm on which the piezoelectric elements are disposed. Accordingly, it is possible to provide electrical wires so as to overlap with the piezoelectric elements, and hence installation of high-density wires becomes possible.

Moreover, the ink pool section (the common liquid chamber or the common flow channel) is disposed across the plurality of pressure chambers from the nozzles (via the diaphragm and the intermediate plate). Hence, it is possible to simplify the composition of a liquid supply channel which connects the ink pool section with each of the pressure chambers, and it is possible to reduce the flow channel resistance with respect to the liquid. Accordingly, the refilling performance can be improved, and it is possible to eject liquid of high viscosity at a high frequency.

BRIEF DESCRIPTION OF THE DRAWINGS

The nature of this invention, as well as other objects and benefits thereof, are explained in the following with reference to the accompanying drawings, in which like reference characters designate the same or similar parts throughout the figures and wherein:

FIGS. 13A and 13B are plan view perspective diagrams of the print head relating to a ninth embodiment, in which FIG. 13A is a general view and FIG. 13B is a partial enlarged view.

DETAILED DESCRIPTION OF THE PREFERRED EMBODIMENTS

General Composition of Inkjet Recording Apparatus

Figure 1:
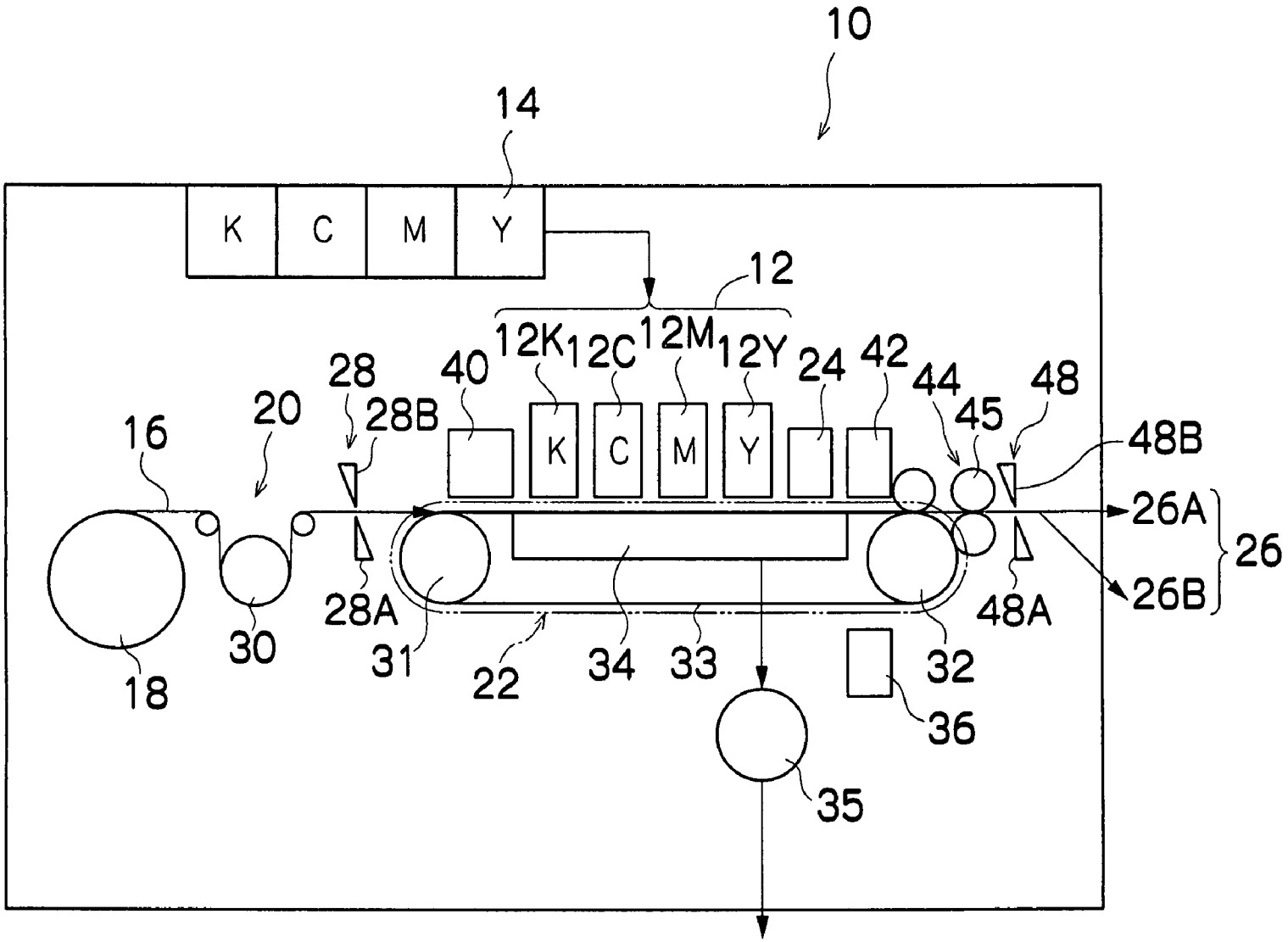
FIG. 1 is a general schematic drawing showing a general view of an inkjet recording apparatus.

FIG. 1 is a general schematic drawing of an inkjet recording apparatus which forms an embodiment of an image forming apparatus to which the present invention is applied. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an embodiment of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane.

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The print unit 12 is a so-called "full line head" in which a line head having a length corresponding to the maximum paper width is arranged in a direction (main-scanning direction) that is perpendicular to the paper conveyance direction (sub scanning direction).

The print heads 12K, 12C, 12M and 12Y forming the print unit 12 are constituted by line heads in which a plurality of ink ejection ports (nozzles) are arranged through a length exceeding at least one edge of the maximum size recording paper 16 intended for use with the inkjet recording apparatus 10.

The print heads 12K, 12C, 12M, 12Y corresponding to respective ink colors are disposed in the order, black (K), cyan (C), magenta (M) and yellow (Y), from the upstream side (left-hand side in FIG. 1), following the direction of conveyance of the recording paper 16 (the paper conveyance direction). A color print can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relative to each other in the paper conveyance direction (sub-scanning direction) just once (in other words, by means of a single sub-scan). Higher-speed printing is thereby made possible and productivity can be improved in comparison with a shuttle type head configuration in which a print head moves reciprocally in the direction (main-scanning direction) that is perpendicular to the paper conveyance direction.

Here, the terms "main scanning direction" and "sub-scanning direction" are used in the following senses. More specifically, in a full-line head comprising rows of nozzles that have a length corresponding to the entire width of the recording paper, "main scanning" is defined as printing one line (a line formed of a row of dots, or a line formed of a plurality of rows of dots) in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning action, while moving the full-line head and the recording paper relatively to each other. The direction in which sub-scanning is performed is called the sub-scanning direction. Consequently, the conveyance direction of the recording paper is the sub-scanning direction and the direction perpendicular to same is called the main scanning direction.

Although the configuration with the KCMY four standard colors is described in the present embodiment, combinations of the ink colors and the number of colors are not limited to those. Light inks or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and 12Y by means of channels (not shown). The ink storing and loading unit 14 has a warning device (for example, a display device, an alarm sound generator or the like) for warning when the remaining amount of any ink is low, and has a mechanism for preventing loading errors among the colors.

The print determination unit 24 has an image sensor (line sensor) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 according to the present embodiment is configured with at least a line sensor having rows of photoelectric transducing elements with a width that is greater than the ink-droplet ejection width (image recording width) of the print heads 12K, 12C, 12M, and 12Y This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in drawings, the paper output unit 26A for the target prints is provided with a sorter for collecting prints according to print orders.

Structure of the Print Heads

Next, various print heads (liquid ejection heads) according to embodiments of the present invention are described. The print heads 12K, 12C, 12M and 12Y provided for the respective ink colors have the same structure, and a reference numeral 50 is hereinafter designated to any of the print heads 12K, 12C, 12M and 12Y.

First Embodiment

Figure 2:
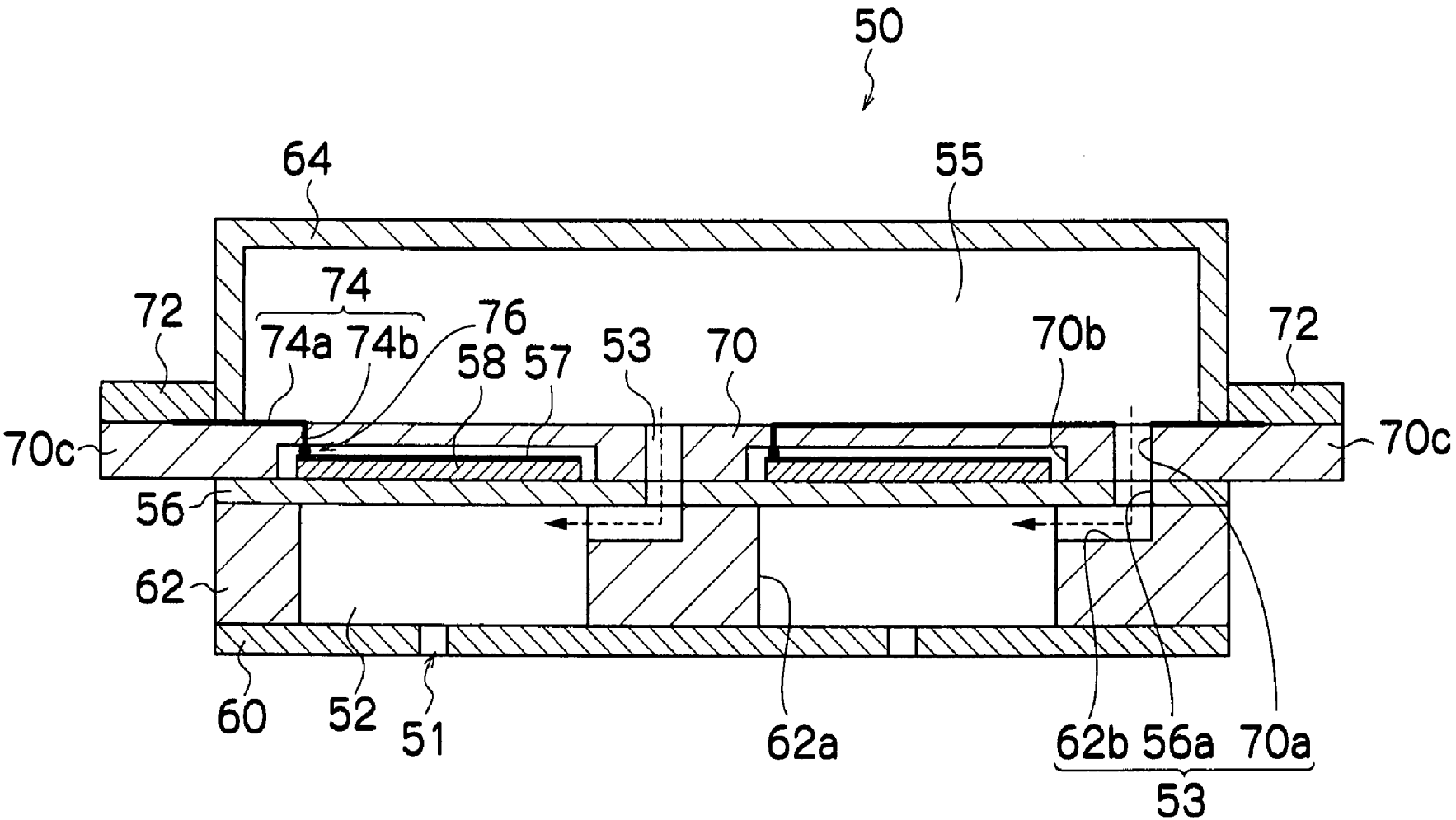
FIG. 2 is a cross-sectional diagram of the print head relating to a first embodiment.

FIG. 2 is a cross-sectional diagram of the print head 50 relating to a first embodiment. The print head 50 relating to the present embodiment is a line head in which a plurality of nozzles 51 are arranged through a length corresponding to the paper width of a recording 20 medium; however, in order to aid understanding of the basic composition of the print head 50, the cross-section of the print head 50 in FIG. 2 is depicted in a simplified fashion.

The print head 50 is composed by stacking a nozzle plate 60, a cavity plate 62, a diaphragm 56, an intermediate plate 70, and an ink pool member 64. Nozzles 51 for ejecting ink droplets are formed in the nozzle plate 60. Holes 62*a* corresponding to the pressure chambers 52, and groove sections 62*b* each of which forms a part of an ink supply channel 53 described hereinafter, are formed in the cavity plate 62. One side of each hole section 62*a* (in FIG. 2, the lower side) is sealed by the nozzle plate 60, and the other side (in FIG. 2, the upper side) is sealed by the diaphragm 56, and hence a pressure chamber 52 is formed thereby.

The ink pool member 64 has a vessel-shaped structure formed so as to be open on one side, and the ink pool member 64 is stacked onto the intermediate plate 70 in such a manner that the open side thereof is orientated toward the lower side, in FIG. 2. The space formed by the ink pool member 64 and the intermediate plate 70 is an ink pool (common liquid chamber) 55 which is composed so as to cover a region corresponding to a plurality of pressure chambers 52. Common flow channels, such as a main flow and a tributary flow, may also be composed in the ink pool 55. The hole sections 70*a* and 56*a* and the groove section 62*b*, each of which constitutes a portion of the ink supply channel 53 provided for each of the pressure chambers 52, are formed respectively in the intermediate plate 70, the diaphragm 56 and the cavity plate 62. The ink pool 55 and the each pressure chamber 52 are connected via an ink supply channel 53 constituted by these members (70*a*, 56*a*, 62*b*). The ink supplied from a tank (not shown) in the ink storing and loading unit 14 shown in FIG. 1 is accumulated in the ink pool 55. Ink is distributed and supplied from the ink pool 55 to the pressure chambers 52, via the ink supply channels 53.

Piezoelectric elements 58 of which individual electrodes (drive electrodes) 57 are provided on the upper surface, are provided at positions corresponding to the pressure chambers 52, on the surface of the diaphragm 56 opposite to the pressure chamber side where the pressure chambers are disposed (in other words, on the surface of the diaphragm 56 on the ink pool side). The diaphragm 56 is made of a conductive member, such as stainless steel, and it also serves as a common electrode for a plurality of piezoelectric elements 58. It is also possible to form a common electrode layer on the surface of the diaphragm 56.

Recess sections 70*b* corresponding to the piezoelectric elements 58 respectively are formed in the intermediate plate 70. Prescribed spaces are guaranteed by the recess sections 70*b* in the peripheral regions of piezoelectric elements 58, and therefore it is possible to achieve a print head 50 having good ejection characteristics, without impeding the displacement of the piezoelectric elements 58.

The intermediate plate 70 is composed so as to be broader than the diaphragm 56 and the ink pool member 64. A drive circuit 72 constituted by a switch IC, for example, is provided on the front surface side (ink pool 55 side) of an extension section 70*c* (of the intermediate plate 70) which projected from the side face of the head.

Electrical wires (internal wires) 74 which are patterned into a prescribed shape are provided in the intermediate plate 70. In the present embodiment, the electrical wires 74 are each constituted by a horizontal section 74*a* formed horizontally over the front surface side (ink pool 55 side) of the intermediate plate 70, from the position where the drive circuit 72 is disposed, and a vertical section 74*b* which passes vertically through the intermediate plate 70 from one end of the horizontal section 74*a*. One end of the electrical wire 74 is electrically connected to the drive circuit 72, and the other end thereof is electrically connected to the individual electrode 57 of the piezoelectric element 58 via an electrical connecting section 76. An insulating and protective film (not shown) made of resin, or the like, is formed on the portion of the surface of the intermediate plate 70 which make contact with the ink inside the ink pool 55.

Next, the planar composition of the print head 50 is described below with reference to FIG. 3 to FIG. 5.

Figure 3:
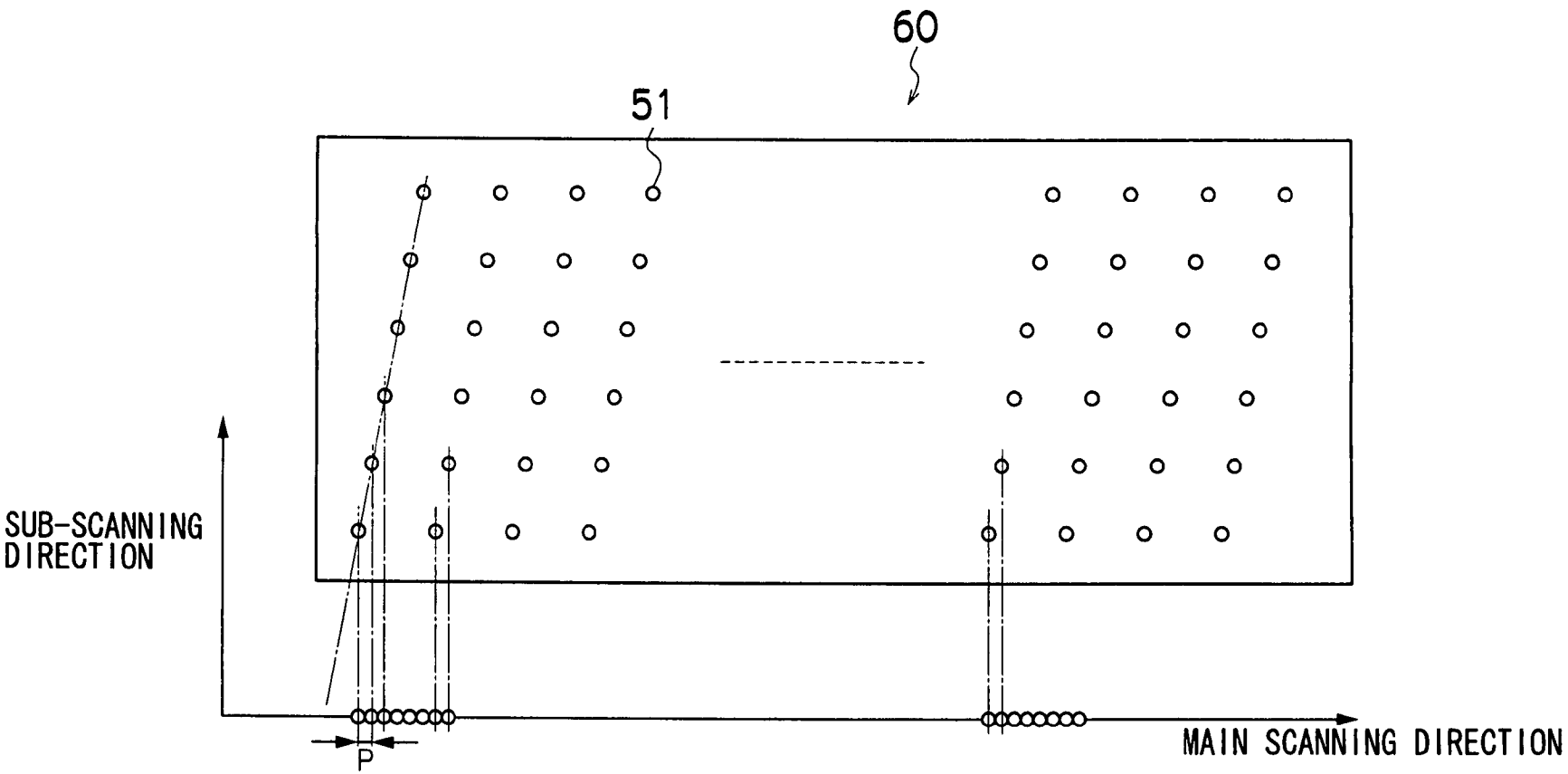
FIG. 3 is a plan diagram of a nozzle plate.

FIG. 3 shows a plan diagram of the nozzle plate 60. As described above, the print head 50 according to the present embodiment is a line head having a length corresponding to the width of the recording medium, and the lengthwise direction of the nozzle plate 60 corresponds to the main scanning direction, while the breadthways direction thereof corresponds to the sub-scanning direction (paper conveyance direction). In the nozzle plate 60, a plurality of nozzles 51 are arranged in a two-dimensional configuration (matrix array) following the lengthwise direction (main scanning direction) and an oblique direction which is not perpendicular to the lengthwise direction. The projected nozzle row obtained by projecting the nozzles to an alignment in the lengthwise direction (main scanning direction) has nozzles arranged at a uniform nozzle pitch P, and hence a high density of the nozzles 51 can be virtually achieved.

Figure 4:
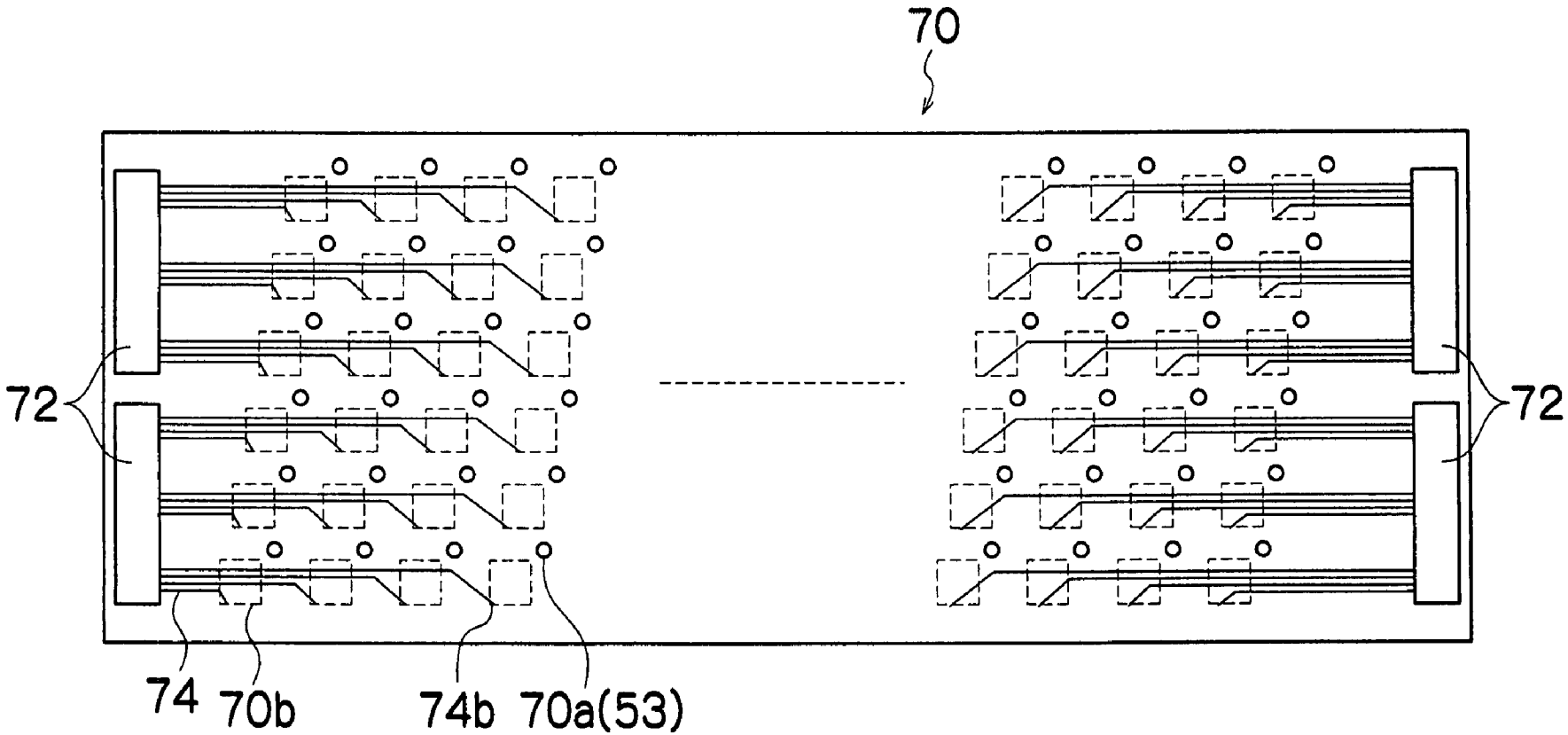
FIG. 4 is a plan diagram of an intermediate plate.

FIG. 4 shows a plan diagram of the intermediate plate 70. In FIG. 4, the recess sections 70*b* corresponding to the arrangement of the piezoelectric elements 58 are depicted by dotted lines. A plurality of drive circuits 72 (in the present embodiment, four drive circuits 72) for driving the piezoelectric elements 58 are provided on either end of the intermediate plate 70 in the lengthwise direction. The electrical wires 74 (corresponding to the horizontal sections 74*a* in FIG. 2) which connect the drive circuits 72 and the recess sections 70*b* are formed on the surface of the intermediate plate 70. The vertical sections 74*b* which pass through the intermediate plate 70 are formed at the end sections of the electrical wires 74, on the near side to the recess section 70*b* (see FIG. 2). Furthermore, the recess sections 70*b* and the hole sections 70*a* which each constitute a portion of an ink supply channel 53 are arranged in a two-dimensional configuration, similarly to the nozzles 51 and the piezoelectric elements 58 described above.

The electrical wires 74 extended from any particular individual electrode 57 via the vertical section 74*b* is patterned on the surface of the intermediate plate 70 in such a manner that they overlap with the positions in which the piezoelectric elements 58 are disposed, and therefore high-density installation can be achieved.

Figure 5:
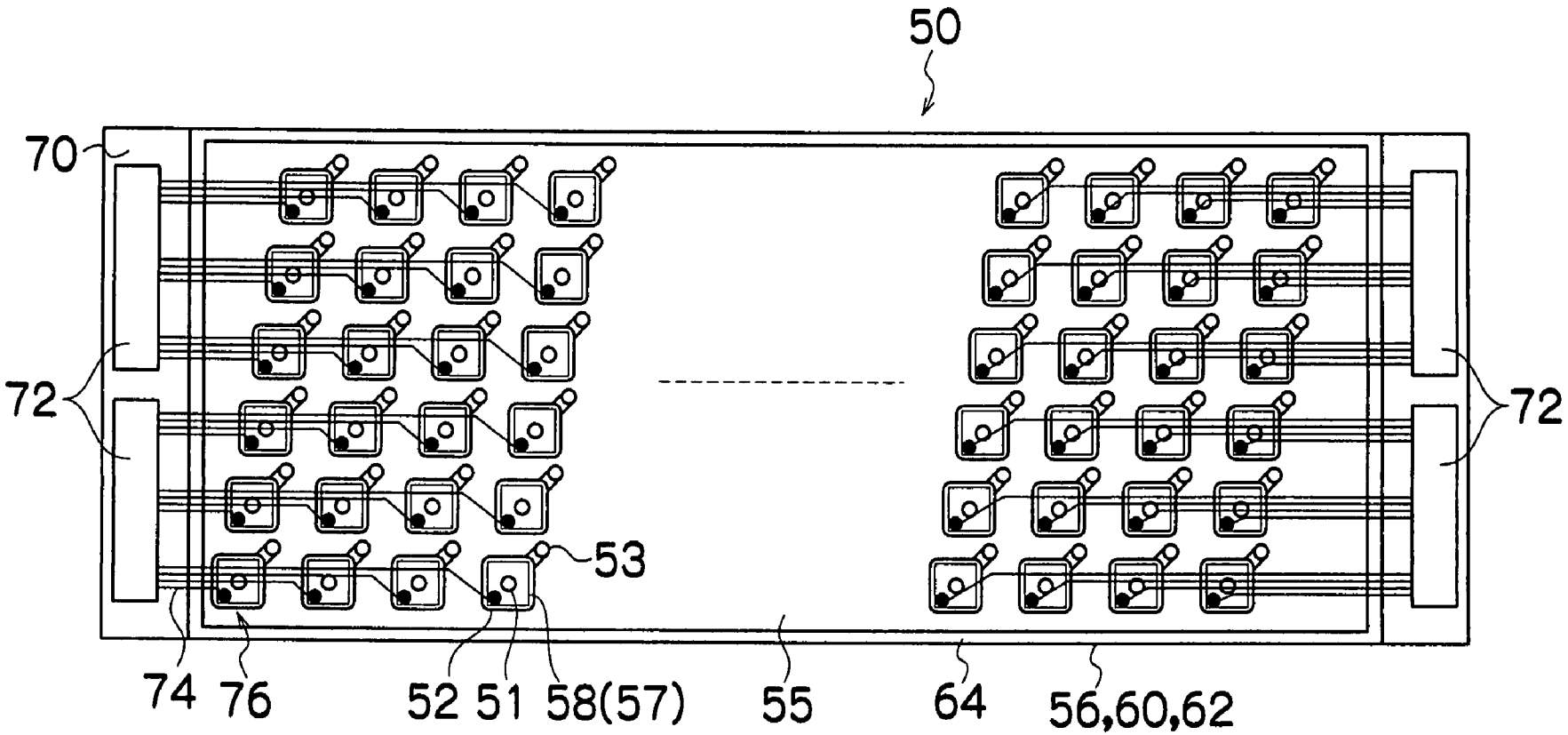
FIG. 5 is a plan view perspective diagram of the print head relating to a first embodiment.

FIG. 5 is a plan view perspective diagram of the print head 50. As shown in FIG. 5, each of the nozzles 51 is disposed in substantially the central area of each of the pressure chambers 52 which have a substantially square shape, and each of the ink supply channels 53 for supplying ink to the pressure chambers 52 is provided obliquely to the upper right-hand side of each pressure chamber 52. Furthermore, the piezoelectric elements 58 are disposed in such a manner that they overlap substantially with the pressure chambers 52. The pressure chambers 52, ink supply channels 53 and piezoelectric elements 58 are respectively arranged in a two-dimensional configuration.

The individual electrodes 57 of the piezoelectric elements 58 are connected electrically to the drive circuits 72, which are disposed to the outer side of the region corresponding to the piezoelectric elements 58 (in other words, on either end section of the intermediate plate 70 in the lengthwise direction), via the electrical connection sections 76 and electrical wires 74. The ink pool 55 constituted by the ink pool member 64 is formed in the region corresponding to the piezoelectric elements 58 and the pressure chambers 52.

In the print head 50 according to the first embodiment, the electrical wires (internal wires) 74 for driving the piezoelectric elements 58 are provided in the intermediate plate 70, which is different from the diaphragm 56 on which the piezoelectric elements 58 are provided, and therefore it is possible to dispose the electrical wires 74 in such a manner that they overlap with the piezoelectric elements 58, as shown in FIG. 5. Consequently, a high-density wiring installation can be achieved.

Furthermore, since the ink pool 55 is disposed on the opposite side of the pressure chambers 52 from the nozzles, via the diaphragm 56 and the intermediate plate 70, then the composition of the ink supply channels 53 which connect the ink pool 55 with each of the pressure chambers 52 is simplified, and therefore it is possible to reduce the flow resistance with respect to the ink. Accordingly, the refilling performance is improved, and it is possible to eject ink of high viscosity at a high frequency.

The action of the print head 50 according to the first embodiment is as described below. When a drive signal (drive voltage) is applied to the individual electrode 82 of a piezoelectric element 58 from a drive circuit 72, via an electrical wire 74, then the piezoelectric element 58 is displaced and the volume of the pressure chamber 52 is reduced. Consequently, the ink inside the pressure chamber 52 is pressurized and an ink droplet is ejected from the nozzle 51 connected to the pressure chamber 52. After that, ink is supplied into the pressure chamber 52 from the ink pool 55 and the pressure chamber 52 is refilled with the ink, in preparation for the next ink ejection operation. The print heads 50 according to the other embodiments described below have a similar action to that described above.

Second Embodiment

Figure 6:
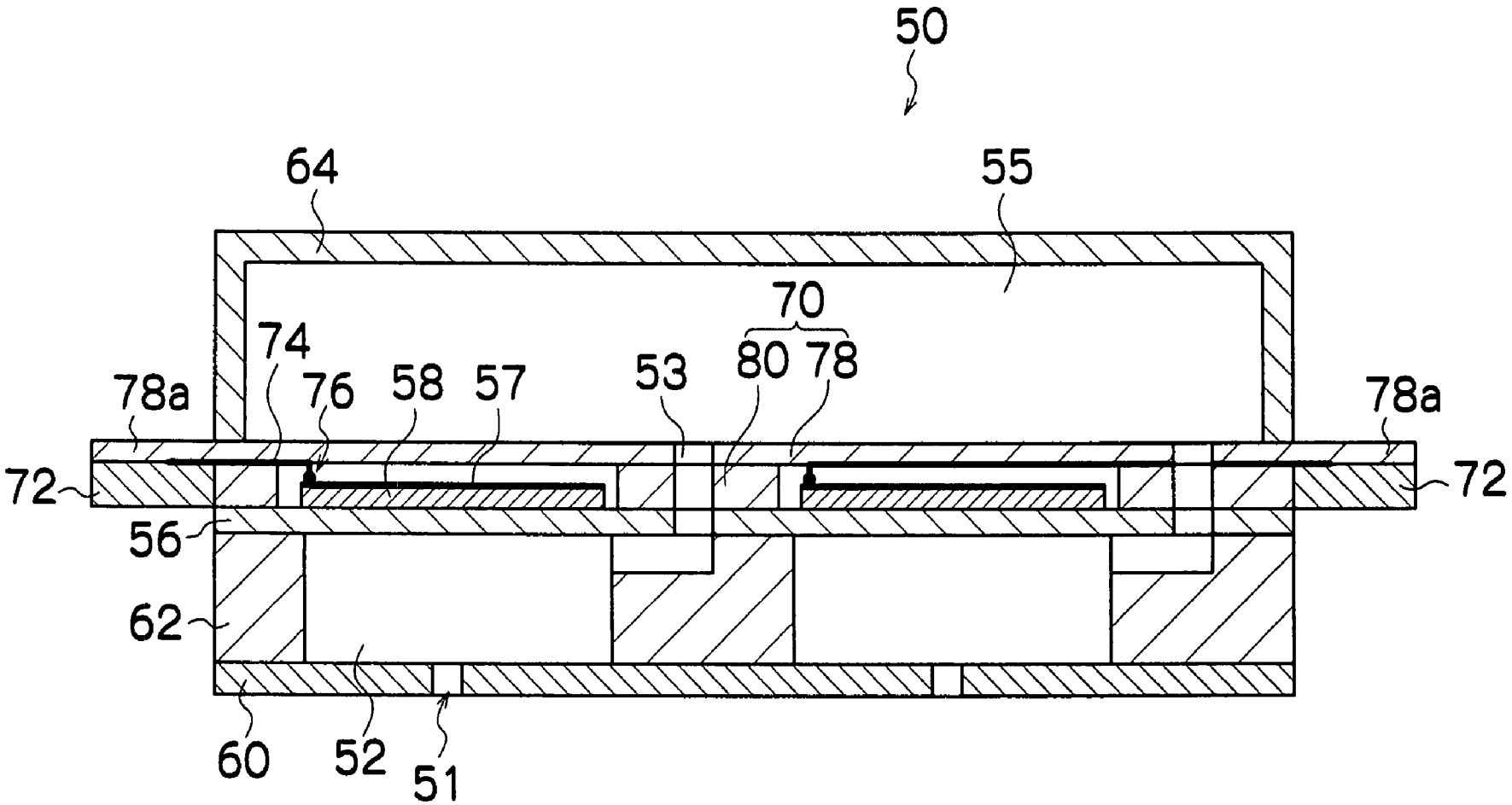
FIG. 6 is a cross-sectional diagram of the print head relating to a second embodiment.

FIG. 6 is a side face cross-sectional diagram of the print head 50 relating to a second embodiment.

In the second embodiment, the intermediate plate 70 having a two-layer composition including an upper plate 78 and a lower plate 80 is used. Similarly to the first embodiment, recess sections 70*b* are formed in the intermediate plate 70, and spaces are guaranteed in the peripheral regions of the piezoelectric elements 58 in such a manner that the displacement of the piezoelectric elements 58 is not impeded.

The lower plate 80 is formed to have substantially the same width as that of the diaphragm 56. On the other hand, the upper plate 78 is formed to have a greater width than that of the diaphragm 56. Drive circuits 72 are formed on the rear surface (diaphragm 56 side) of extension sections 78*a* of the upper plate 78 which project from the side faces of the head. The electrical wires 74 are patterned onto the rear surface (diaphragm 56 side) of the upper plate 78, one end of each wire 74 being connected electrically to a drive circuit 72 and the other end thereof being connected electrically to the individual electrode 57 of a piezoelectric element 58 via an electrical connecting section 76.

In the case of the second embodiment, similarly to the first embodiment, the wires are provided in the intermediate substrate 70, which is different from the diaphragm 56 on which the piezoelectric elements 58 are disposed, and hence it is possible to install high-density wiring. Furthermore, the intermediate plate 70 can be composed readily from a plurality of plate members 78 and 80, and hence the manufacture of the print head 50 is simplified. Moreover, electrical wires 74 are disposed on the rear surface side (diaphragm 56 side) of the upper plate 78, and hence the electrical wires 74 do not make contact with the ink inside the ink pool 55, and hence there is no requirement to carry out electrical insulation processing on the front surface (ink pool 55 side) on the upper plate 78.

Third Embodiment

Figure 7:
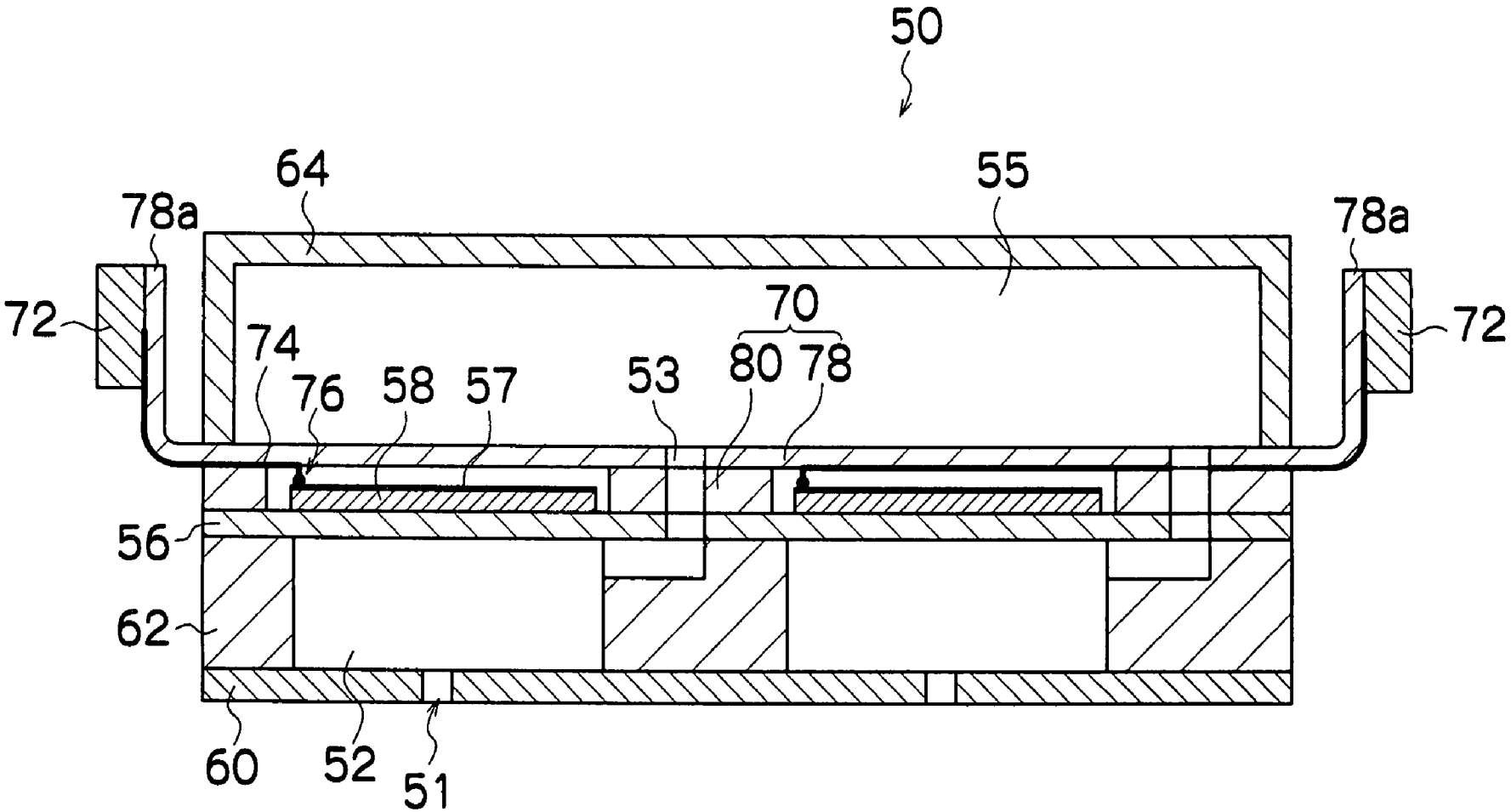
FIG. 7 is a cross-sectional diagram of the print head relating to a third embodiment.

FIG. 7 is a side face cross-sectional diagram of the print head 50 relating to a third embodiment.

Similarly to the second embodiment, in the third embodiment, the intermediate plate 70 has a two-layer composition, but it differs in that the upper plate 78 is formed by a bendable elastic sheet, and as shown in FIG. 7, the extension sections 78*a* of the upper plate 78 are bent toward the ink pool 55 side. The upper plate 78 can be made of FPC, polyimide, for example. Compared to the second embodiment, the clearance with respect to the recording medium is increased and the size of the print head 50 can be reduced.

Fourth Embodiment

Figure 8:
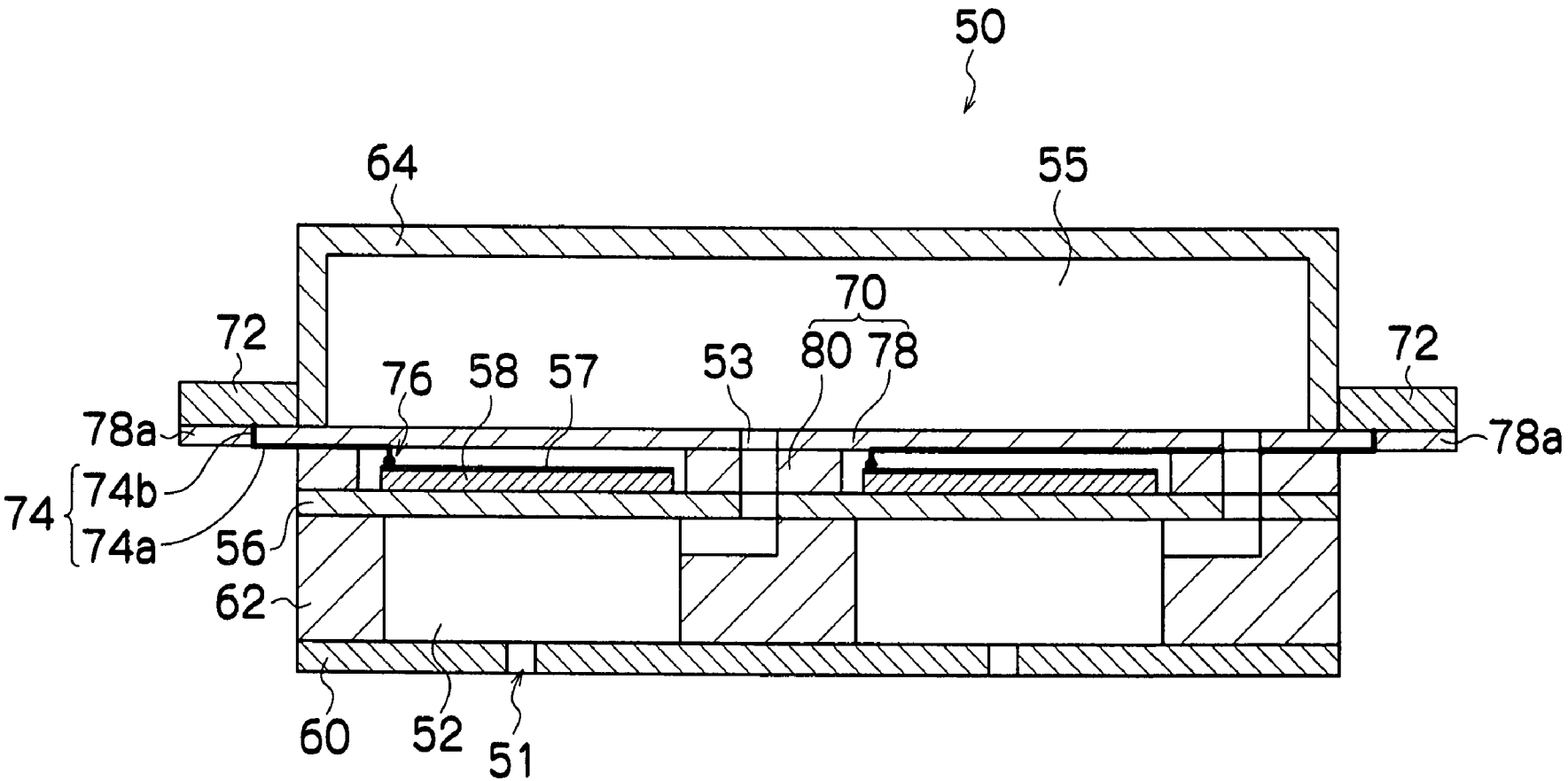
FIG. 8 is a cross-sectional diagram of the print head relating to a fourth embodiment.

FIG. 8 is a side face cross-sectional diagram of the print head 50 relating to a fourth embodiment.

In the second embodiment, a composition is adopted in which drive circuits 72 are disposed on the rear surface side of the upper plate 78 (see FIG. 6), whereas in the fourth embodiment, as shown in FIG. 8, the drive circuits 72 are provided on the front surface side (ink pool 55 side) of the upper plate. Moreover, the horizontal sections 74*a* of the electrical wires 74 are formed on the rear surface side (diaphragm 56 side) of the upper plate 78, and the vertical sections 74*b* are formed at the positions where the drive circuits 72 are disposed. Compared to the second embodiment, the clearance with respect to the recording medium is increased and it is possible to prevent damage to the drive circuits 72 by the recording medium.

Fifth Embodiment

Figure 9:
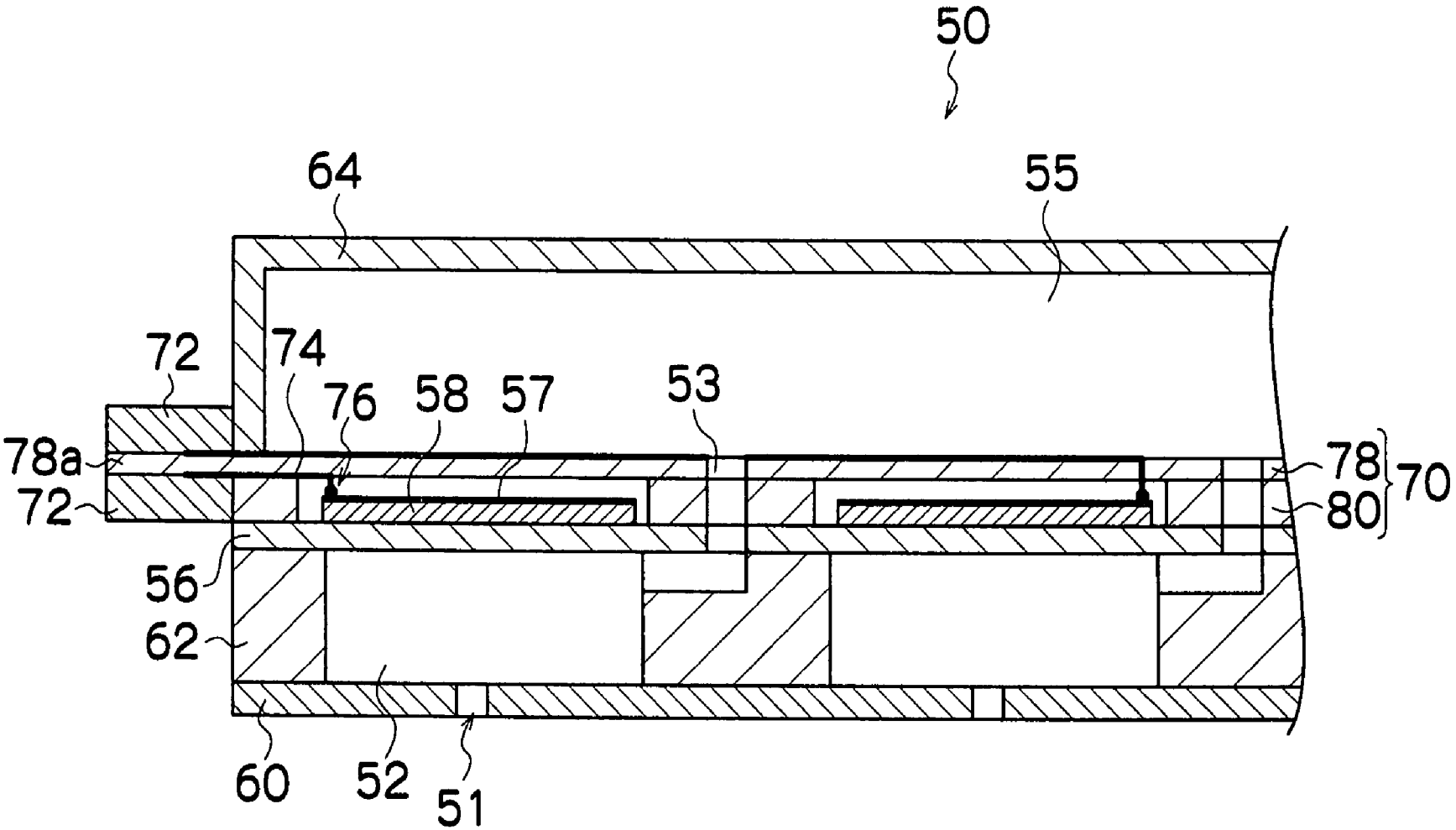
FIG. 9 is a cross-sectional diagram of the print head relating to a fifth embodiment.

FIG. 9 is a cross-sectional diagram of the print head 50 relating to a fifth embodiment.

The fifth embodiment shows a mode where the second and fourth embodiments are combined. In other words, a composition is adopted in which the drive circuits 72 and the electrical wires 74 are provided on the front and rear surfaces of the upper plate 78. An insulating and protective film (not shown) is formed on the portions of the front surface of the upper plate 78 which make contact with the ink inside the ink pool 55. As a result, compared to the second and fourth embodiments, it is possible to install the wires at high density, and the size of the print head 50 can be reduced.

Sixth Embodiment

Figure 10:
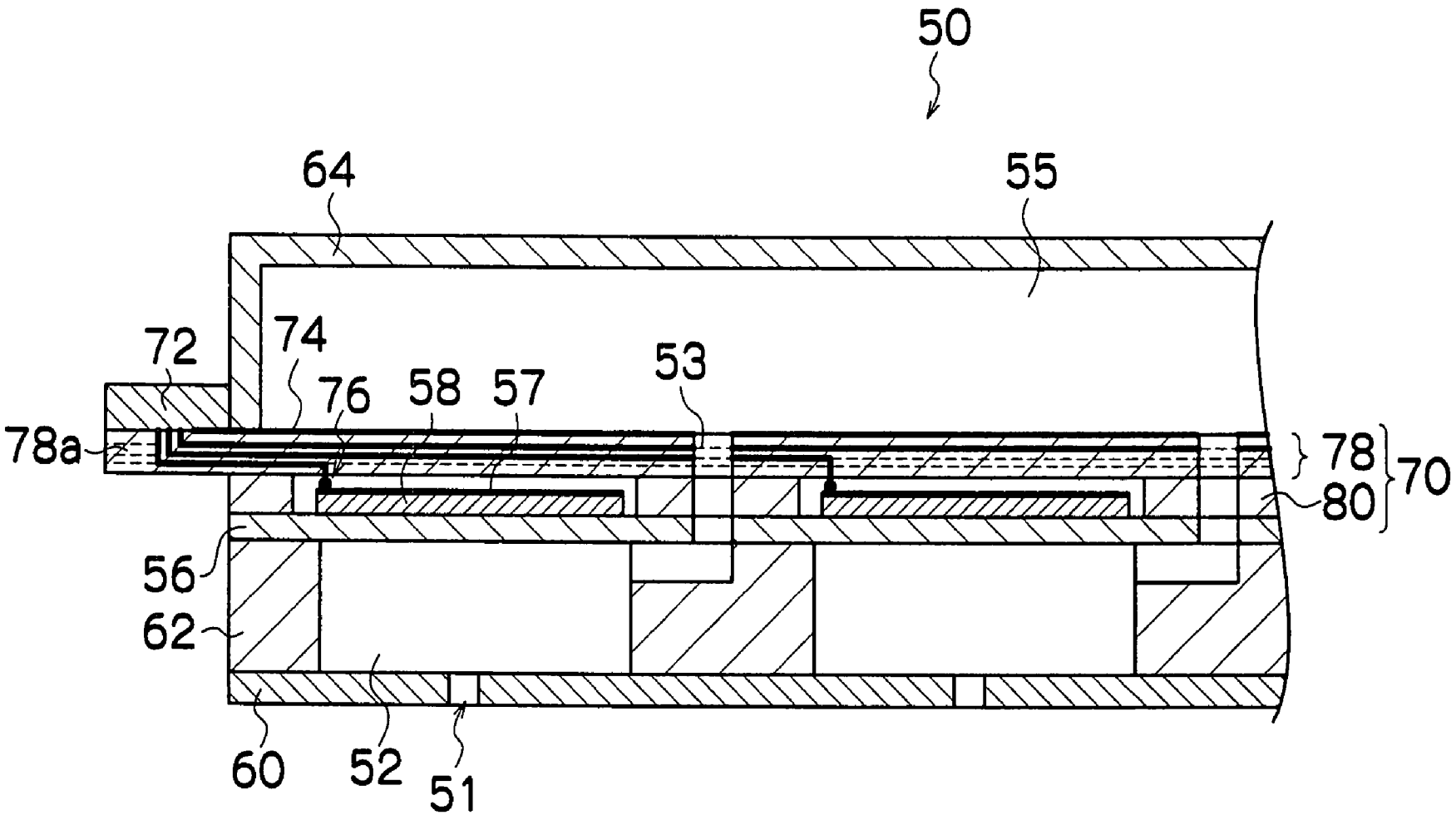
FIG. 10 is a cross-sectional diagram of the print head relating to a sixth embodiment.

FIG. 10 is a cross-sectional diagram of the print head 50 relating to a sixth embodiment.

The sixth embodiment is a mode where the upper plate 78 is constituted by a multi-layer plate. The electrical wires 74 which electrically connect the drive circuits 72 and the individual electrodes 57 of the piezoelectric elements 58, are formed so as to be distributed in the respective layers of the upper plate 78. Thereby, it is possible to install wires at even higher density, and to reduce the wiring density with respect to each layer can be reduced. Hence the wiring task can be simplified.

Seventh Embodiment

Figure 11:
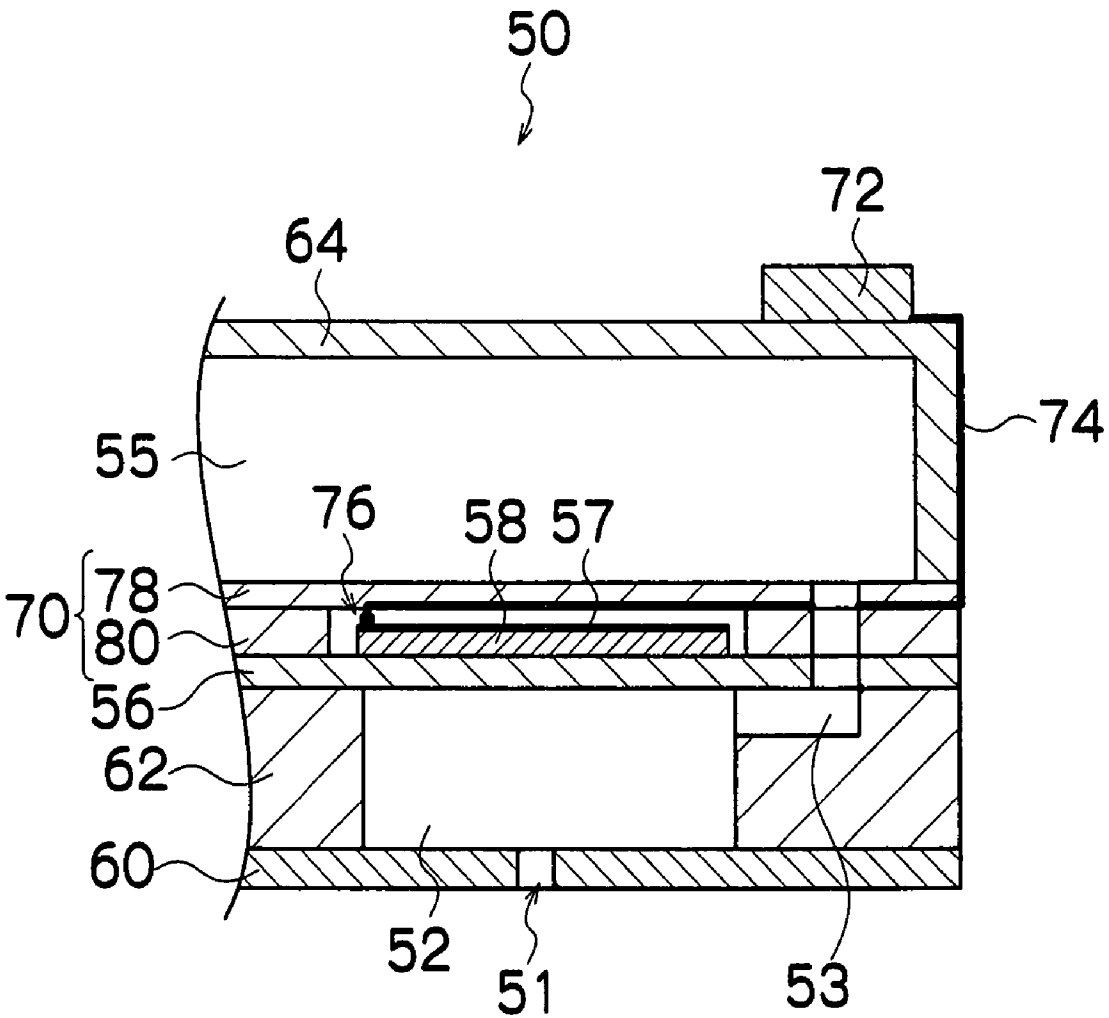
FIG. 11 is a cross-sectional diagram of the print head relating to a seventh embodiment.

FIG. 11 is a cross-sectional diagram of the print head 50 relating to a seventh embodiment.

The seventh embodiment is a mode in which the drive circuits 72 are disposed on the upper part of the print head 50, in other words, on the upper surface of the ink pool member 64 constituting the walls of the ink pool 55. The electrical wires 74 are extended to the end sections along the rear surface (diaphragm 56 side) of the upper plate 78, and moreover they are bent around towards the ink pool 55 side, and furthermore they are extended along the side face and upper face of the ink pool member 64; that is, the electrical wires 74 are extended to the position where the dive circuits 72 are disposed, along the upper plate 78 and the ink pool member 64.

Desirably, the ink pool member 64 is made from a material having a high thermal conductivity. For example, ceramics (thermal conductivity: 15-30 W/m·K) and alumina (thermal conductivity: 17 W/m·K) are suitable for the material of the ink pool member 64. According to this composition, an effect in radiating the heat generated by the drive circuits 72 is achieved. The drive circuits 72 may be provided on the side face of the ink pool member 64.

Furthermore, if the ink pool member 64 is made of resin, then desirably, inorganic particles are contained in the resin in order to improve thermal conductivity. For example, by incorporating 80% to 90% (percentage by weight) of micro-particles of alumina or ceramics in a thermosetting type epoxy resin, and then molding the resin, it is possible to achieve both good moldability and good heat release characteristics, simultaneously.

Eighth Embodiment

Figure 12:
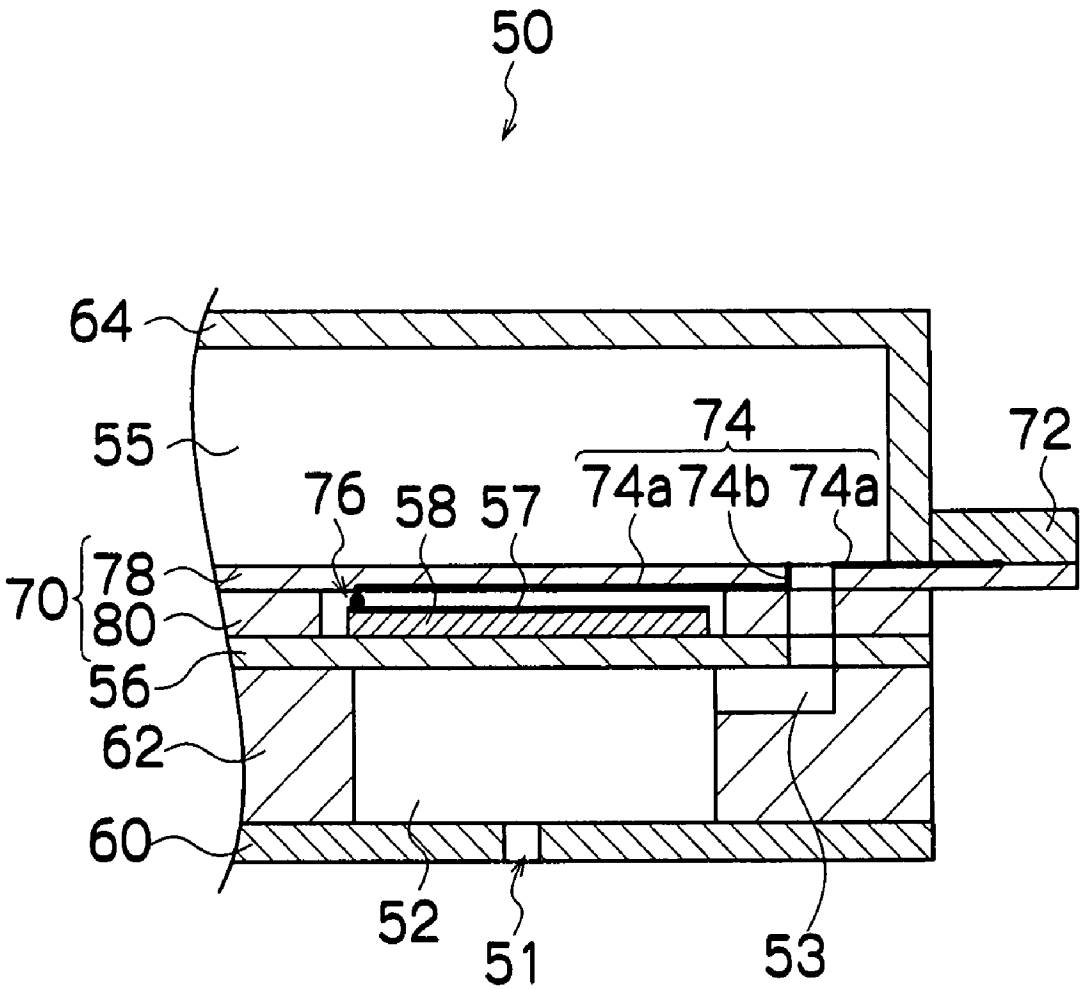
FIG. 12 is a cross-sectional diagram of the print head relating to an eighth embodiment.

FIG. 12 is a cross-sectional diagram of the print head 50 relating to an eighth embodiment.

The eighth embodiment is a mode in which the vertical sections 74*b* of the electrical wires 74 are formed on the internal surfaces of the ink supply channels 53. The horizontal sections 74*a* of the electrical wires 74 are formed on the front and rear surfaces of the upper plate 78; the horizontal sections are located on the rear surface side at the piezoelectric element 58 side, whereas the horizontal sections are located on the front surface side at the drive circuit 72 side. The horizontal sections 74*a* of the electrical wires 74 on the front surface side and the rear surface side are connected electrically via vertical sections 74*b* formed on the inner surfaces of the ink supply channels 53. By disposing a portion of each of the electrical wires 74 on the internal surface of the ink supply channel 53, it is possible to distribute the electrical wires 74 to the front and rear surfaces of the upper plate 78, and therefore, installation of high-density wires can be achieved.

Ninth Embodiment

Figure 13A:
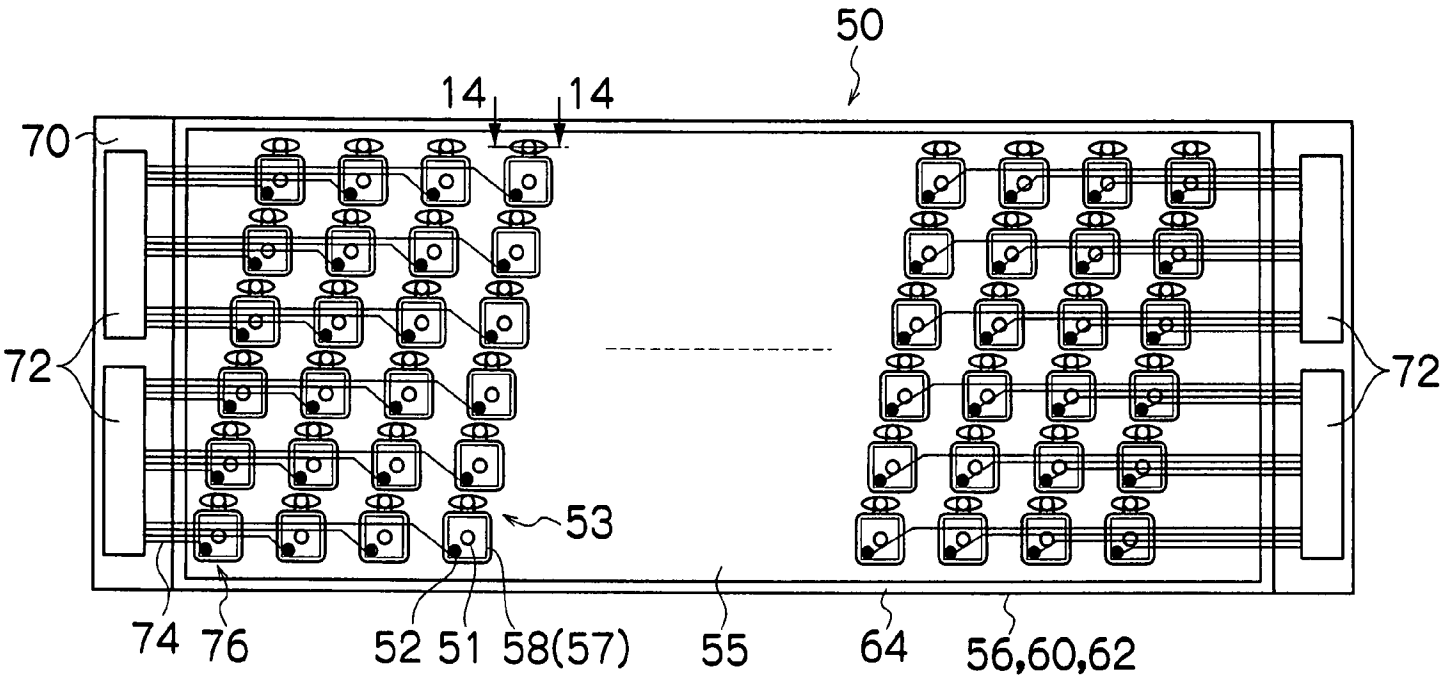
Figure 13B:
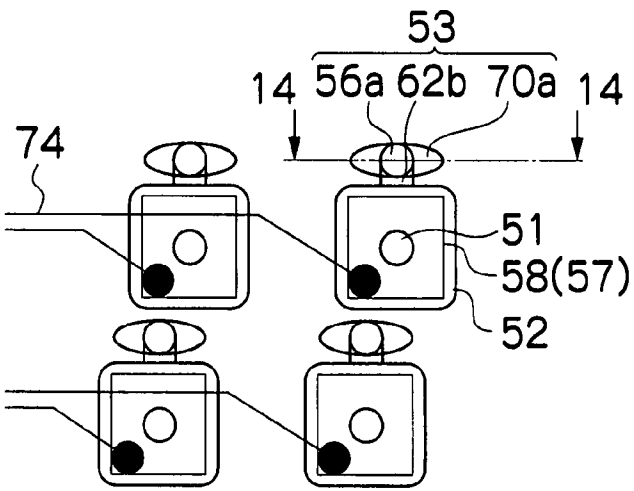
Figure 14:
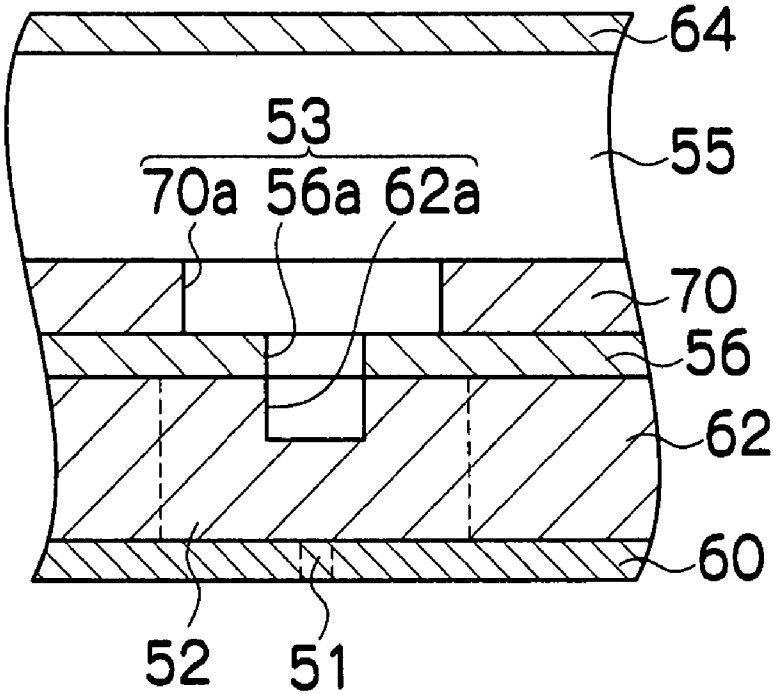
FIG. 14 is a cross-sectional diagram along line 14-14 in FIGS. 13A and 13B.

FIGS. 13A and 13B are plan view perspective diagrams of the print head 50 according to a ninth embodiment. FIG. 13A is a general diagram of a print head 50, and FIG. 13B is an enlarged diagram showing a partial enlargement of same. FIG. 14 is a cross-sectional diagram along line 14-14 in FIGS. 13A and 13B. In FIGS. 13A and 13B and FIG. 14, parts which are common to those in FIG. 5 are labeled with the same reference numerals.

As shown in FIGS. 13A and 13B, each ink supply channel 53 provided corresponding to each pressure chamber 52 comprises: a hole section (elongated hole) 70*a* which is elongated in the lengthwise direction of the print head 50; a hole section 56*a* which has a diameter substantially the same length as the breadthways length of the hole section 70*a*, and which is disposed substantially in the center of the hole section 70*a;* and a groove section 62*b* composed so as to connect the hole section 56*a* with the pressure chamber 52. As shown in FIG. 14, the hole section 70*a*, the hole section 56*a* and the groove section 62*b* are respectively formed in the intermediate plate 70, the diaphragm 56 and the cavity plate 62, and thereby an ink supply channel 53 which connects the ink pool 55 with the pressure chamber 52 is constituted.

The cross sectional area of the hole section (elongated hole) 70*a* in the intermediate plate 70 is formed so as to be larger than the cross sectional area of the hole section 56*a* formed in the diaphragm 56. The pressure loss in a flow channel is inversely proportional to the value of the $4^{th}$ power of the flow channel diameter, and it is directly proportional to the flow channel length and the viscosity of the liquid. Consequently, in the ninth embodiment, the pressure loss in the ink supply channel 53 is reduced in comparison with those in the first to eighth embodiments, and therefore this composition enables excellent refilling performance and is suitable for ejecting high-viscosity ink at a high frequency.

Furthermore, by forming the hole sections (elongated holes) 70*a* in the intermediate plate 70 so that they are elongated in the direction of extension of the electrical wires 74 (in other words, the lengthwise direction of the print head 50), then it becomes possible to install the electrical wires 74 to a higher density on the intermediate plate 70, compared to a case where the hole sections 70*a* have a circular shape.

In the embodiments described above, the electrical wires 74 which form electrical connections between the individual electrodes 57 of the piezoelectric elements 58 and the drive circuits 72, are concentrated in the intermediate plate 70, and therefore they can be inspected readily after making the electrical connections. Furthermore, the structure of the electrical wires 74 in the print head 50 is simplified, which has a beneficial effect in reducing costs.

The liquid ejection head and the image forming apparatus according to embodiments of the present invention have been described in detail above, but the present invention is not limited to the aforementioned embodiments, and it is of course possible for improvements and modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head comprising:

a plurality of pressure chambers connected to a plurality of nozzles from which liquid is ejected, the pressure chambers being arranged in a two-dimensional configuration;

a diaphragm which constitutes a wall of each of the pressure chambers, the wall being located opposite to the nozzles;

a plurality of piezoelectric elements disposed at positions corresponding to the pressure chambers on a surface of the diaphragm which is on an opposite side of the diaphragm from the pressure chambers, the piezoelectric elements causing portions of the diaphragm corresponding to the pressure chambers to deform;

an intermediate plate which is located on a piezoelectric element side of the diaphragm where the piezoelectric elements are disposed and which forms a space around a periphery of each of the piezoelectric elements;

electrical wires for electrically connecting drive circuits which drives the piezoelectric elements with drive electrodes of the piezoelectric elements, the electrical wires being disposed in the intermediate plate; and an ink pool section which is located across the intermediate plate from the diaphragm and which supplies the liquid to the pressure chambers, wherein the intermediate plate includes a hole section;

the diaphragm includes a hole section which constitutes a portion of a liquid flow channel;

cross-sectional area of the hole section included in the intermediate is greater than cross-sectional area of the hole section included in the diaphram; and the hole section included in the intermediate plate is an elongated hole which is elongated in a wiring direction in which the electrical wires in the intermediate plate are extended.

2. The liquid ejection head as defined in claim 1, wherein the electrical wires are disposed in the intermediate plate in such a manner that at least a portion of the electrical wires overlaps with the piezoelectric elements.

3. The liquid ejection head as defined in claim 1, wherein the intermediate plate includes at least a plate member where the electrical wires are disposed.

4. The liquid ejection head as defined in claim 3, wherein the electrical wires are disposed on a diaphragm side of the plate member.

5. The liquid ejection head as defined in claim 3, wherein the electrical wires are disposed on both surfaces of the plate member.

6. The liquid ejection head as defined in claim 5, wherein the drive circuits are disposed on both surfaces of the plate member.

7. The liquid ejection head as defined in claim 5, wherein the plate member is made of a bendable sheet material; and the plate member is bent toward an ink pool section side in a region other than regions where the piezoelectric elements are disposed.

8. The liquid ejection head as defined in claim 3, wherein the plate member includes a plurality of layers on which the electrical wires are disposed.

9. The liquid ejection head as defined in claim 1, wherein a portion of the electrical wires is disposed on an internal surface of a hole section of the intermediate plate which constitutes a portion of a liquid supply channel which connects the ink pool section with each of the pressure chambers.

10. The liquid ejection head as defined in claim 1, wherein a partition constituting the ink pool section includes at least a heat radiation member; and the drive circuits are disposed on the partition.

11. An image forming apparatus comprising the liquid ejection head as defined in claim 1.

* * * * *